US009121654B2

(12) United States Patent
Arnedo Vera et al.

(10) Patent No.: US 9,121,654 B2
(45) Date of Patent: Sep. 1, 2015

(54) FIRING MECHANISM FOR A SPORTING RIFLE

(71) Applicant: GAMO OUTDOOR, S.L., Sant Boi de Llobregat (ES)

(72) Inventors: Julian Arnedo Vera, Barcelona (ES); Victor Tresserras Torre, Barcelona (ES)

(73) Assignee: GAMO OUTDOOR S.L., Barcelona (ES)

( * ) Notice: Subject to any disclaimer, the term of this patent is extended or adjusted under 35 U.S.C. 154(b) by 0 days.

(21) Appl. No.: 14/371,673

(22) PCT Filed: Dec. 20, 2012

(86) PCT No.: PCT/ES2012/070888

§ 371 (c)(1),
(2) Date: Jul. 10, 2014

(87) PCT Pub. No.: WO2013/104810

PCT Pub. Date: Jul. 18, 2013

(65) Prior Publication Data

US 2014/0373417 A1 Dec. 25, 2014

(30) Foreign Application Priority Data

Jan. 13, 2012 (ES) ..... 201230051

(51) Int. Cl.

| | |
|---|---|
| ***F41A 19/10*** | (2006.01) |
| ***F41B 11/70*** | (2013.01) |
| ***F41A 17/46*** | (2006.01) |
| ***F41A 19/06*** | (2006.01) |
| ***F41A 19/12*** | (2006.01) |
| ***F41A 19/17*** | (2006.01) |
| ***F41B 11/62*** | (2013.01) |
| ***F41A 17/54*** | (2006.01) |

(52) U.S. Cl.

CPC ..... *F41A 19/10* (2013.01); *F41A 17/46* (2013.01); *F41A 17/54* (2013.01); *F41A 19/06* (2013.01); *F41A 19/12* (2013.01); *F41A 19/17* (2013.01); *F41B 11/62* (2013.01); *F41B 11/70* (2013.01)

(58) Field of Classification Search

USPC ..... 42/69.01, 69.02, 69.03; 89/128–132
See application file for complete search history.

(56) References Cited

U.S. PATENT DOCUMENTS

| | | | | |
|---|---|---|---|---|
| 2,387,788 | A | 10/1945 | Wiles | |
| 5,052,141 | A * | 10/1991 | Sammons | 42/69.01 |
| 8,453,554 | B2 * | 6/2013 | Landies et al. | 89/140 |
| 8,459,172 | B2 * | 6/2013 | Landies et al. | 89/140 |
| 2011/0168008 | A1 | 7/2011 | Landies | |
| 2011/0225863 | A1 * | 9/2011 | Tresserras Torre | 42/69.01 |
| 2013/0112183 | A1 * | 5/2013 | Arnedo Vera | 124/32 |
| 2014/0007481 | A1 * | 1/2014 | Tresserras Torre et al. | 42/76.1 |

FOREIGN PATENT DOCUMENTS

| | | | |
|---|---|---|---|
| DE | 102006048436 | A1 | 2/2008 |
| EP | 2372294 | A1 | 10/2011 |

OTHER PUBLICATIONS

International search report dated Jun. 5, 2013 in corresponding PCT Application No. PCT/ES2012/070888 filed Dec. 20, 2012.

* cited by examiner

*Primary Examiner* — Michael David
(74) *Attorney, Agent, or Firm* — RatnerPrestia

(57) ABSTRACT

This comprises a trigger (5), a trigger safety catch (6), a pawl (18) with a piston locking tooth (23) counter-pawl (19) in simultaneous contact with the pawl (18) and trigger (5), with said counter-pawl (19) also being kinetically coupled to trigger (5), with the referred first section (19) locking pawl (18) movement and which frees said locking when the trigger (5) is moved.

5 Claims, 8 Drawing Sheets

FIRING MECHANISM FOR A SPORTING RIFLE

CROSS REFERENCE TO RELATED APPLICATIONS

This application is a 371 application of International Application No. PCT/ES2012070888, filed Dec. 20, 2012, which claims priority to Spanish Patent Application 201230051, filed Jan. 13, 2012, all of which are incorporated by reference in its entirety herein.

DESCRIPTION

Firing mechanism for a sporting rifle, that comprises a trigger, a trigger safety catch, a pawl with a piston locking tooth, a counter-pawl in simultaneous contact with the pawl and trigger, with said counter-pawl also being kinetically coupled to the trigger, with the referred first section locking pawl movement and which frees said locking when the trigger is moved, characterised in that it comprises a first spring, arranged between the trigger and counter-pawl, which is compressed and moves upward when operated by the finger of the user acting on the trigger and which, when decompressed returns the trigger to its initial position and a second spring between the pawl and the counter-pawl, with one of the spring arms arranged so that the breakdown of forces means the necessary turning torque of the second spring decreases with respect to the rotation angle of the counter-pawl, thus reducing the user driving force when the trigger is rotated.

BACKGROUND OF THE INVENTION

The inventors are known in the sporting rifle sector as great innovators, especially with respect to compressed air and CO2 rifles and pistols. Within this line of improvement, this patent refers to a sporting rifle firing mechanism.

Spanish patent No 0493802 (ES8104552), "Arma de tiro de aire comprimido", from 1980 is also known, in the name of AIR MATCH S.A.R.L., which refers to a compressed air firearm. It essentially comprises a frame, a barrel mounted on the same, a butt that can be closed against a stationary shoulder, a chamber with a displaceable piston to action of suction and compression and a firing mechanism, constituting a block applicable or separable from the overall block. The compression chamber is opened and closed by the valve and is communicated by the passes with the barrel. The piston is bolted to an operating lever to action the suction and compression movements. Firing is produced by operating the trigger which, by means of a series of levers and mechanisms, operates the impulse lever and the valve. Of application for mounting in pistol or carbine shaped.

European patent No 0467089 "Semi-automatic compressed gas pistol" is also known, from 1991 in the name of Mr Thomas G. KOTSIOPOULOS, which refers to a compressed gas pistol fitted with a semi-automatic firing mechanism that allows successive firing sequences. The firing mechanism includes a closure fitted with a latch arm with a cam at one end and an interconnection element at the other. The cam is positioned to close a firing chamber as the latch arm rotates. The interconnection element is positioned to release an actuator bolt as the latch arm rotates. A rewind spring positions the actuator bolt to mate with the interconnection element once the firing chamber is discharged.

The present applicant company is also that of patent WO2010061010 "TRIGGER MECHANISM FOR SPORTING RIFLE", from 2008, which comprises a piston, a rigid profile, a trigger and a trigger safety catch and because it also has a wall, firmly attached to the rigid profile, which comprises the trigger and safety catch on one of the faces of said wall and similarly with the other face free, a first stud firmly attached to the trigger, a cover that partially covers the trigger and safety catch and said cover consists of an aperture, in the form of a slider, allowing the first stud to pass through it and for the movement of said first stud along the length of said aperture and a slider arranged over the cover in which, with the barrel broken, the referred slider will block the movement of said stud along the length of the aperture, thus immobilizing the trigger and, in the closed barrel position, the mentioned slider allows the movement of the first stud along the aperture

DISCLOSURE OF THE INVENTION

This invention is an improvement in the compressed air or CO2 sporting rifle sector.

The closest document is patent WO2010061010.

With this invention, the inventors create a new, more sensitive, firing mechanism line, in which the known firing times, the first and second times, are better marked or defined, so that the user has enhanced control over the moment of firing.

Unlike firing mechanisms currently available on the market, this second firing time, has an ascending force curve (greater trigger movement results in greater force) until firing occurs. This firing mechanism property means that when the decision is made to fire, the force exerted on the trigger by the finger has to increase until the counter-pawl releases the pawl, without any clear indication of when firing is going to occur.

In this type of firing mechanism, the only way of making a more flexible form (in which the firing moment is better defined) is by reducing the locking zone between the counter-pawl and pawl.

In this way, it is possible to achieve firing with only a small counter-pawl movement. However, this solution negatively affects rifle safety because of any incident the rifle can shoot (such as it falling to the ground etc).

On the other hand, in this invention, as previously stated, the second firing time has a descending force curve (greater trigger movement involves less force).

This characteristic, due to the special design of the second time spring, second spring causes that when the decision is made to fire, the greater force occurs at beginning of travel. So that when trigger movement commences, firing will reliably occur since, to stop the firing action, the force produced by the finger would have to be reduced instantaneously, which is quite difficult.

In addition to the first spring compression load, since the first time spring is directly supported on the counter-pawl it is reducing the second spring compression load, the second time spring by the same amount.

All this results in a more reliable firing mechanism, with better defined first and second times that are also much more flexible.

This solution produces a flexible firing mechanism without the need to reduce the locking zone between the counter-pawl and pawl, so that rifle safety is maintained by preventing firing during accidental incidents.

Summing up, the idea behind this application is to achieve a firing mechanism with the first and second times much better defined, with lower action loads and being more flexible, without losing anything in terms of safety.

One object of this invention is a firing mechanism for a sporting rifle, of the type comprising a trigger, a trigger safety catch, a pawl with a piston locking tooth un counter-pawl in simultaneous contact with the pawl and trigger, with said counter-pawl also being kinetically coupled to the trigger, with the referred first section locking pawl movement and which frees said locking when the trigger is moved, characterised in that it comprises a first spring, arranged between the trigger and counter-pawl, which is compressed and moves upward when operated by the finger of the user acting on the trigger and which, when decompressed returns the trigger to its initial position and a second spring between the pawl and the counter-pawl, with one of the spring arms arranged so that the breakdown of forces means the necessary turning torque of the second spring decreases with respect to the rotation angle of the counter-pawl, thus reducing the user driving force when the trigger is rotated.

BRIEF DESCRIPTION OF THE DRAWINGS

In order to facilitate the description, this report is accompanied by eight sheets of drawings in which a practical exemplary embodiment is represented, which is only cited as a non-limiting example of the scope of the present invention.

SPECIFIC EXEMPLARY EMBODIMENT OF THIS INVENTION

Figure 1:
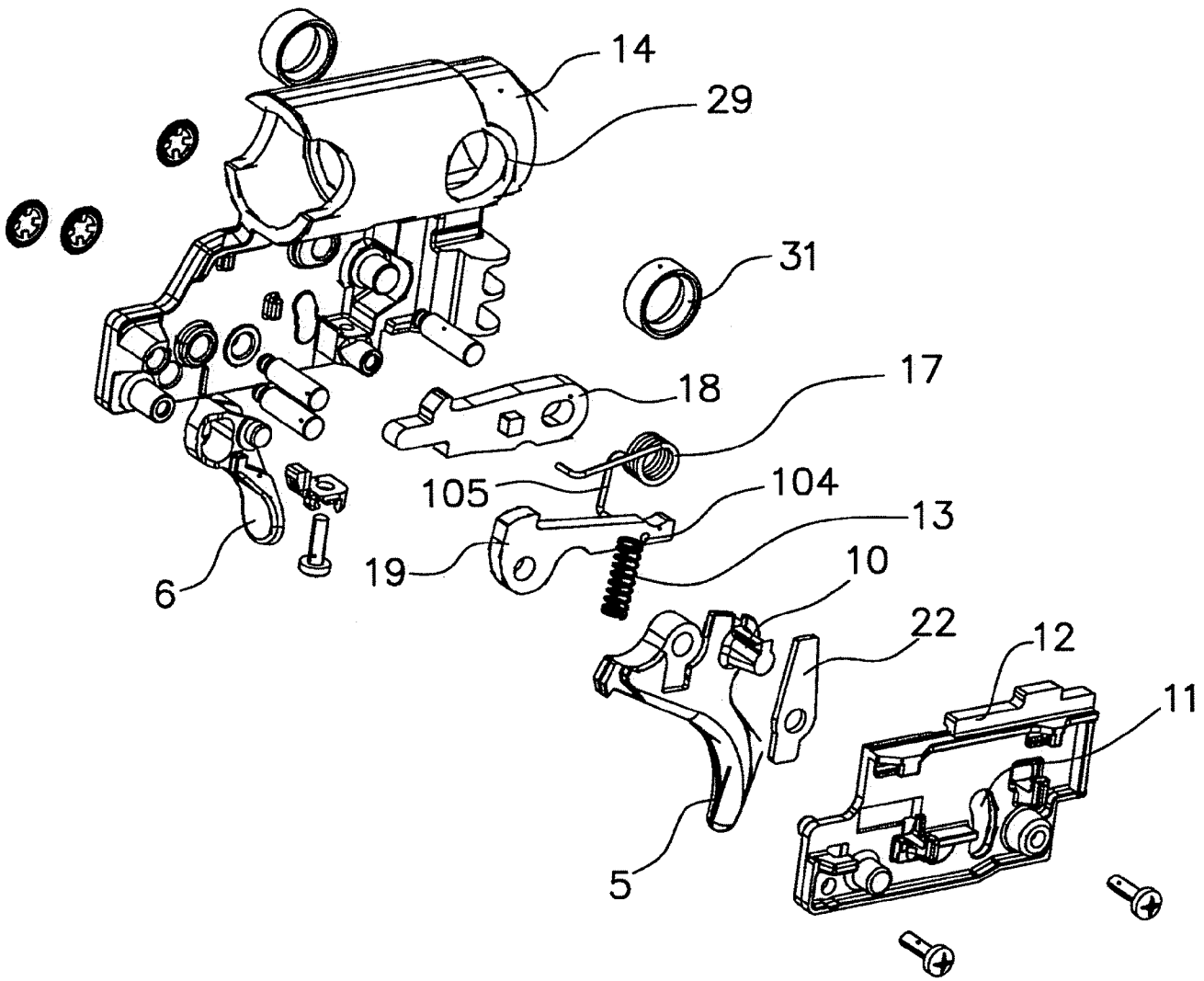
FIG. 1 is an exploded view of the components forming part of the firing mechanism object by this invention.

FIG. 1 illustrates rigid profile 14, pass-through orifice 29, damping washer 31, top 12, with aperture 11 for trigger stub 10, mentioned trigger 5 with first spring 13, safety catch 6, pawl 18, second spring 17, counter-pawl 19 and fall safety catch 22.

Figure 2:
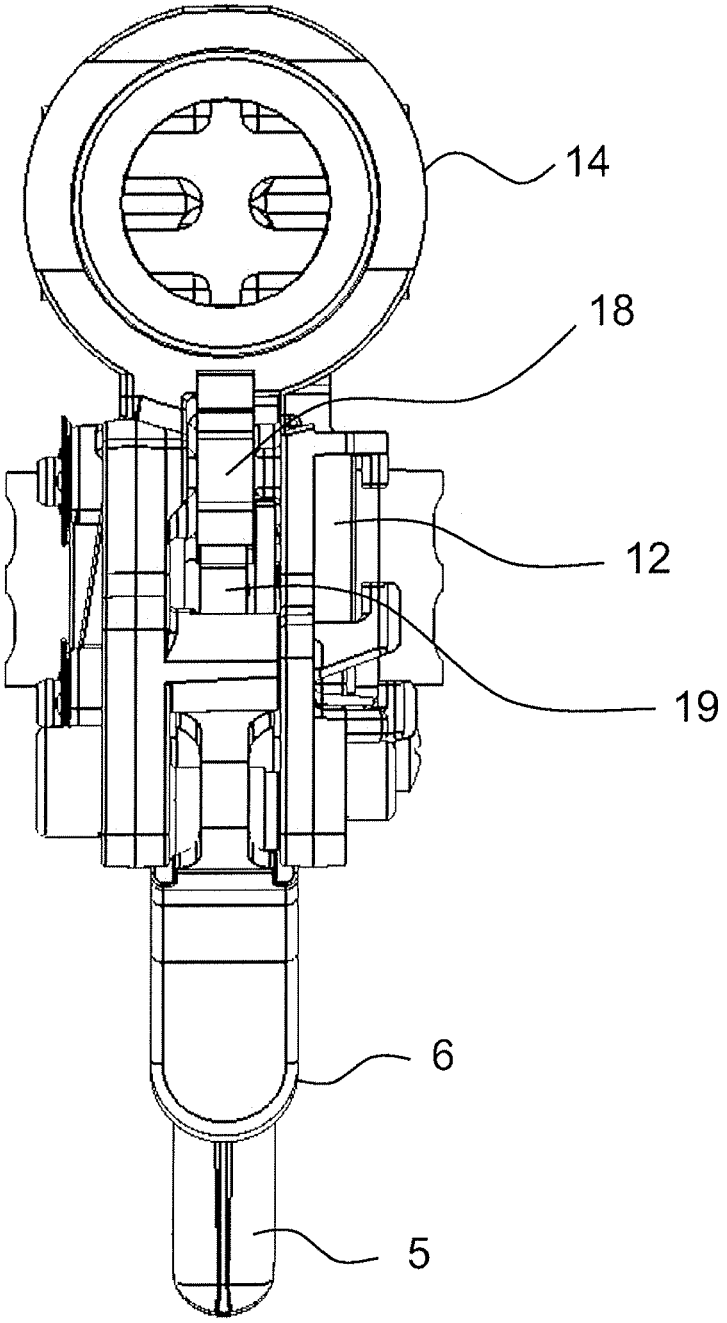
FIG. 2 is a partial view of the firing mechanism in a frontal perspective.

FIG. 2 shows trigger 5, safety catch 6, rigid profile 14, top 12, pawl 18 and counter-pawl 19.

Figure 3:
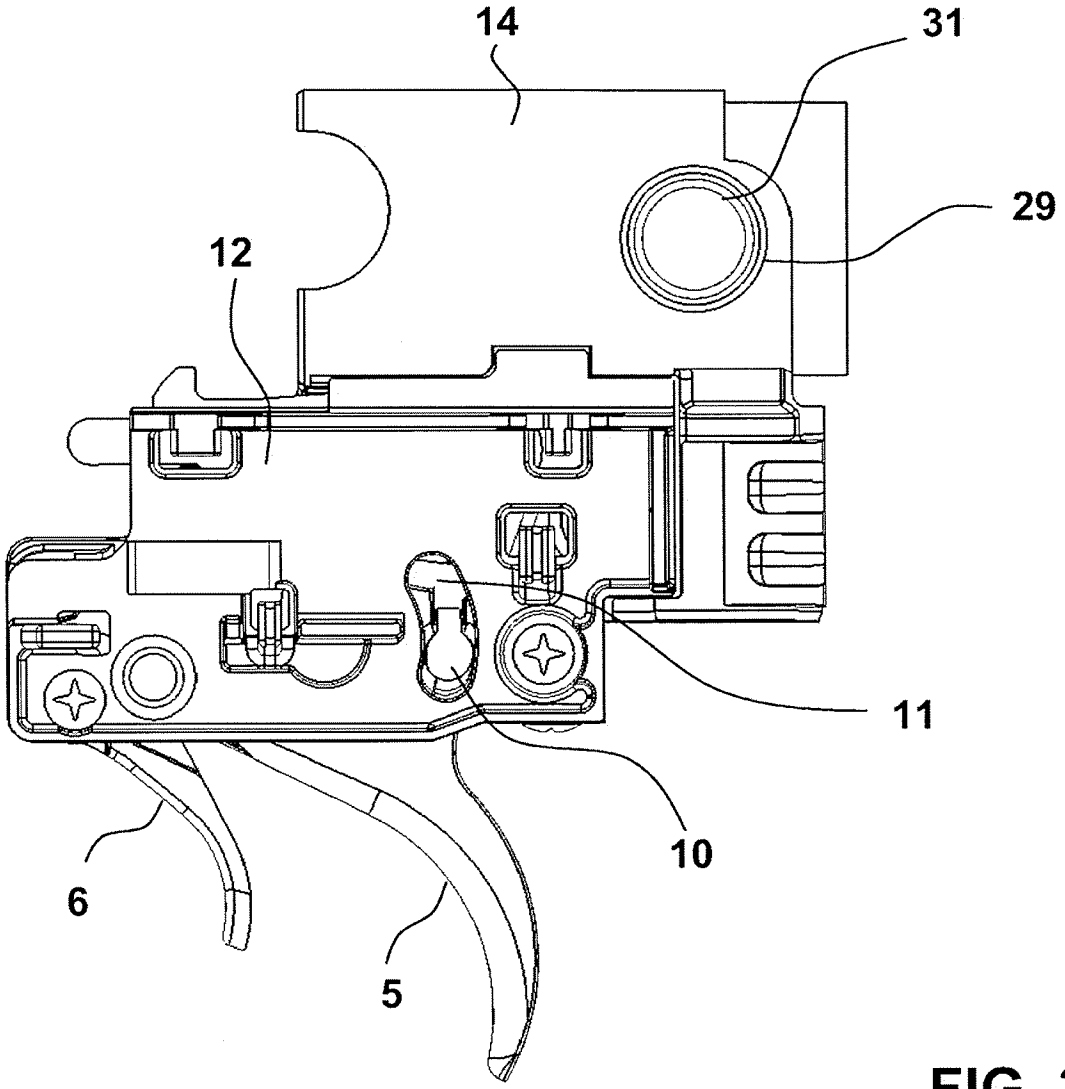
FIG. 3 is a lateral view of the referred firing mechanism without the slider or the spring guide.

FIG. 3 indicates a rigid profile 14, pass-through orifice 29, damping washer 31, top 12, aperture 11 for trigger stub 10, trigger 5 and safety catch 6.

Figure 4:
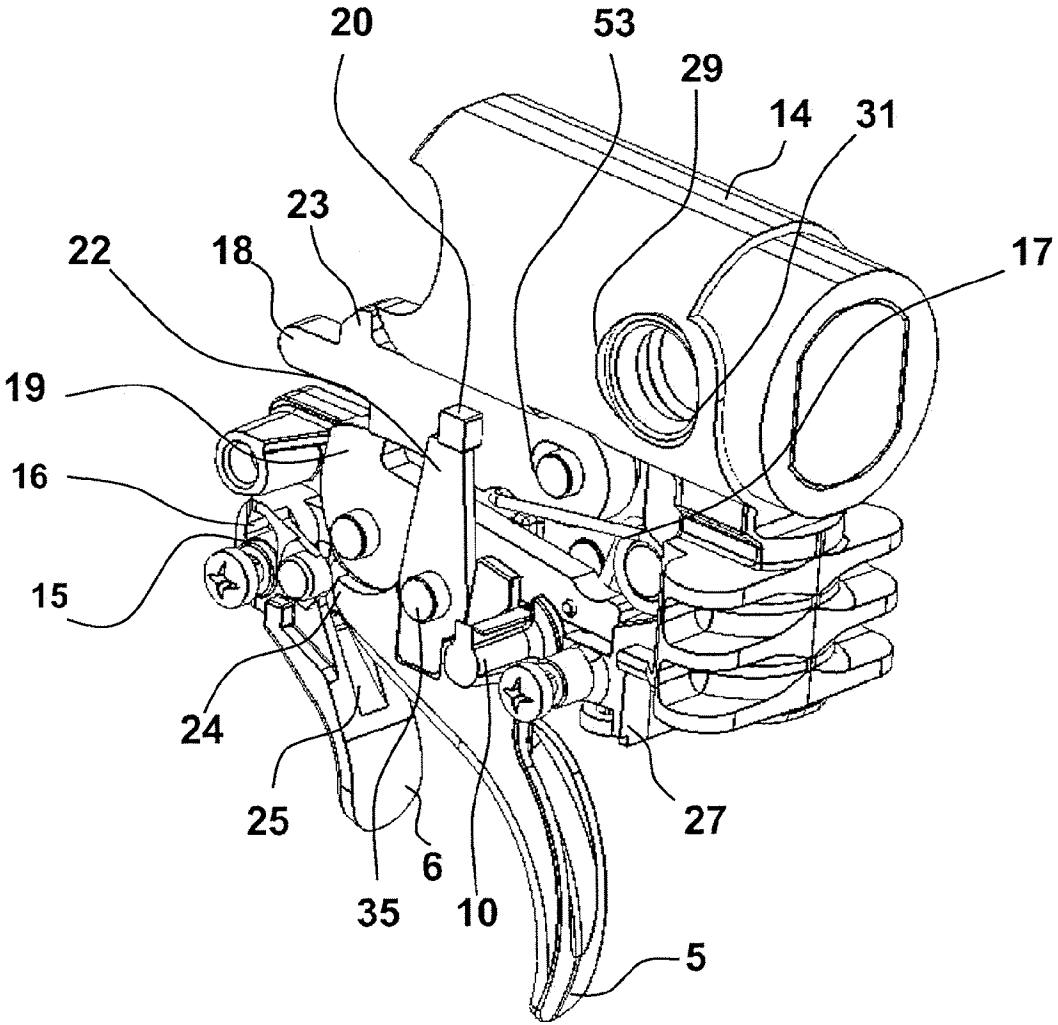
FIG. 4 is a perspective view from behind of the mentioned FIG. 3, without the top and with the firing mechanism in the rest position.

FIG. 4 illustrates rigid profile 14 with wall 27, pass-through orifice 29, damping washer 31, safety catch 6, trigger 5 with stub 10, shaft 35 and projection 24, first groove 25, aperture 16 in the safety catch containing stub 15 of the rigid profile, counter-pawl 19, fall safety catch 22 in its initial position, second spring 17 and pawl 18 with tooth 23, elongated hole 53 and stop 20.

Figure 5:
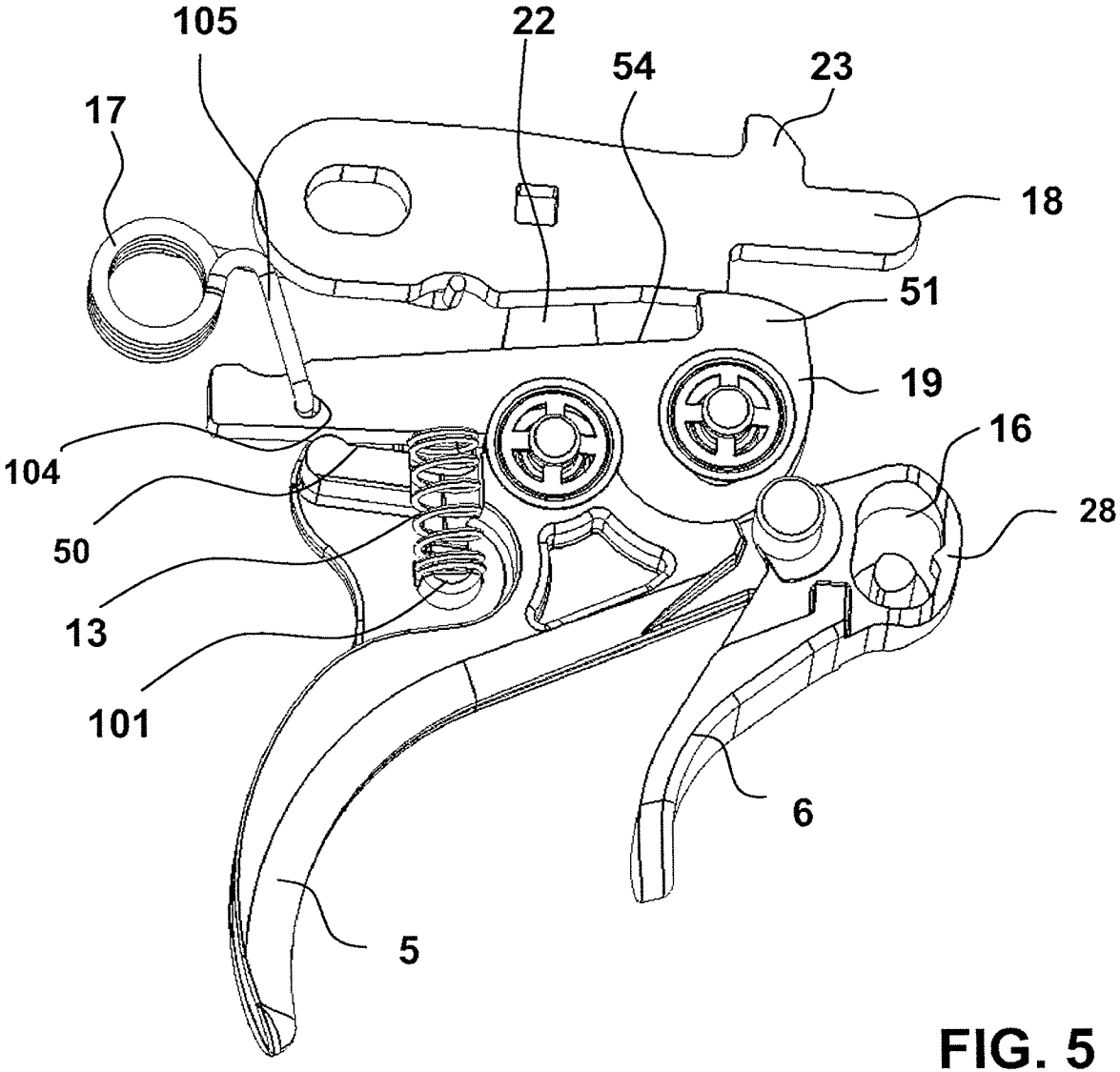
FIG. 5 is a view, without the rigid profile, in interior perspective from behind, from the right side and with the firing mechanism in the rest position.
Figure 6:
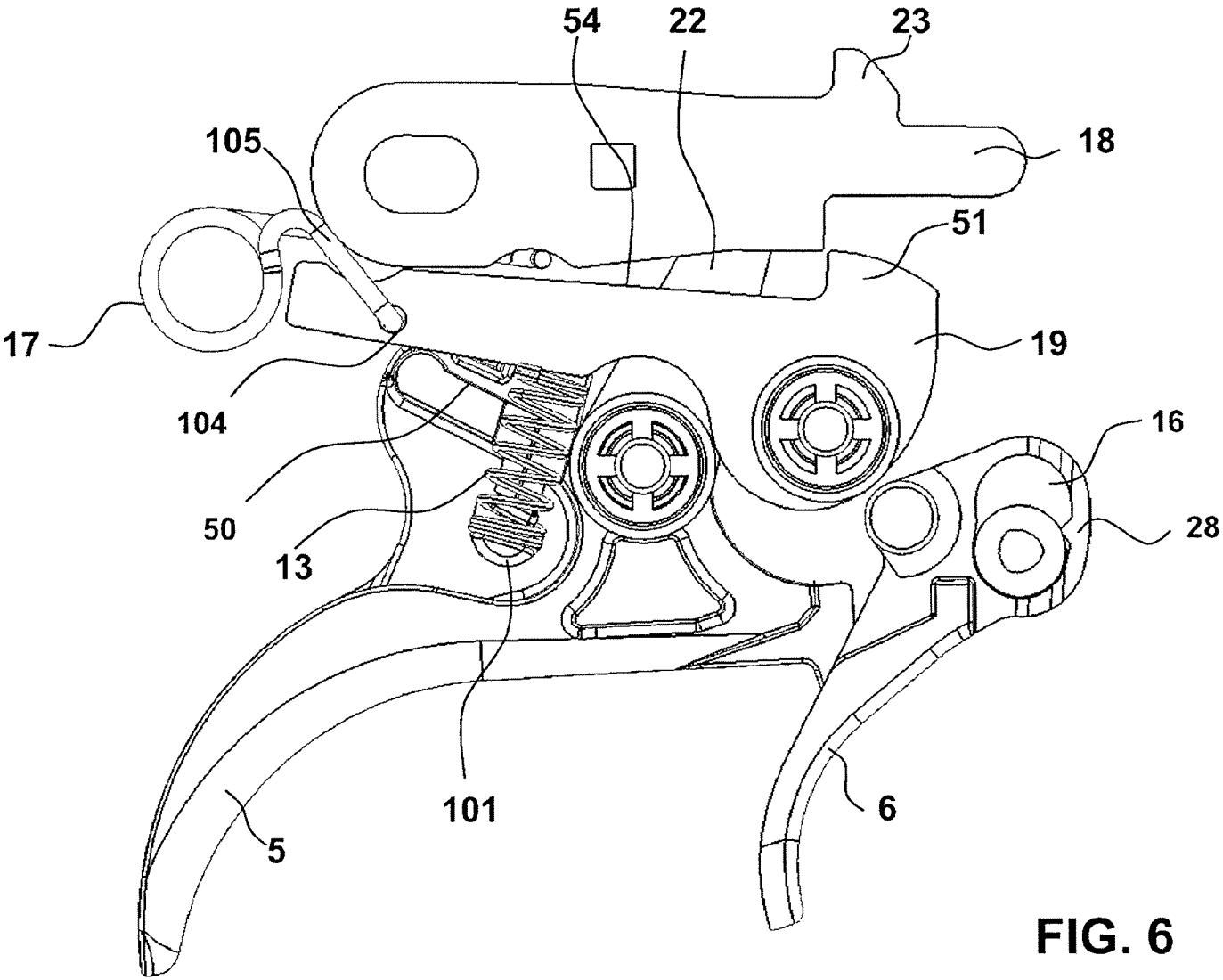
FIG. 6 is a lateral view from the right, without the rigid profile and with the firing mechanism already fired.

FIGS. 5 and 6 show first spring 13, projection 101, second spring 17 with arm 105, safety catch 6 with its aperture 16 and constriction 28, counter-pawl 19 with notch 54, its interference zone 51 and orifice 104, fall safety catch 22, pawl 18 with its tooth 23, trigger 5 and contact zone 50.

Figure 7:
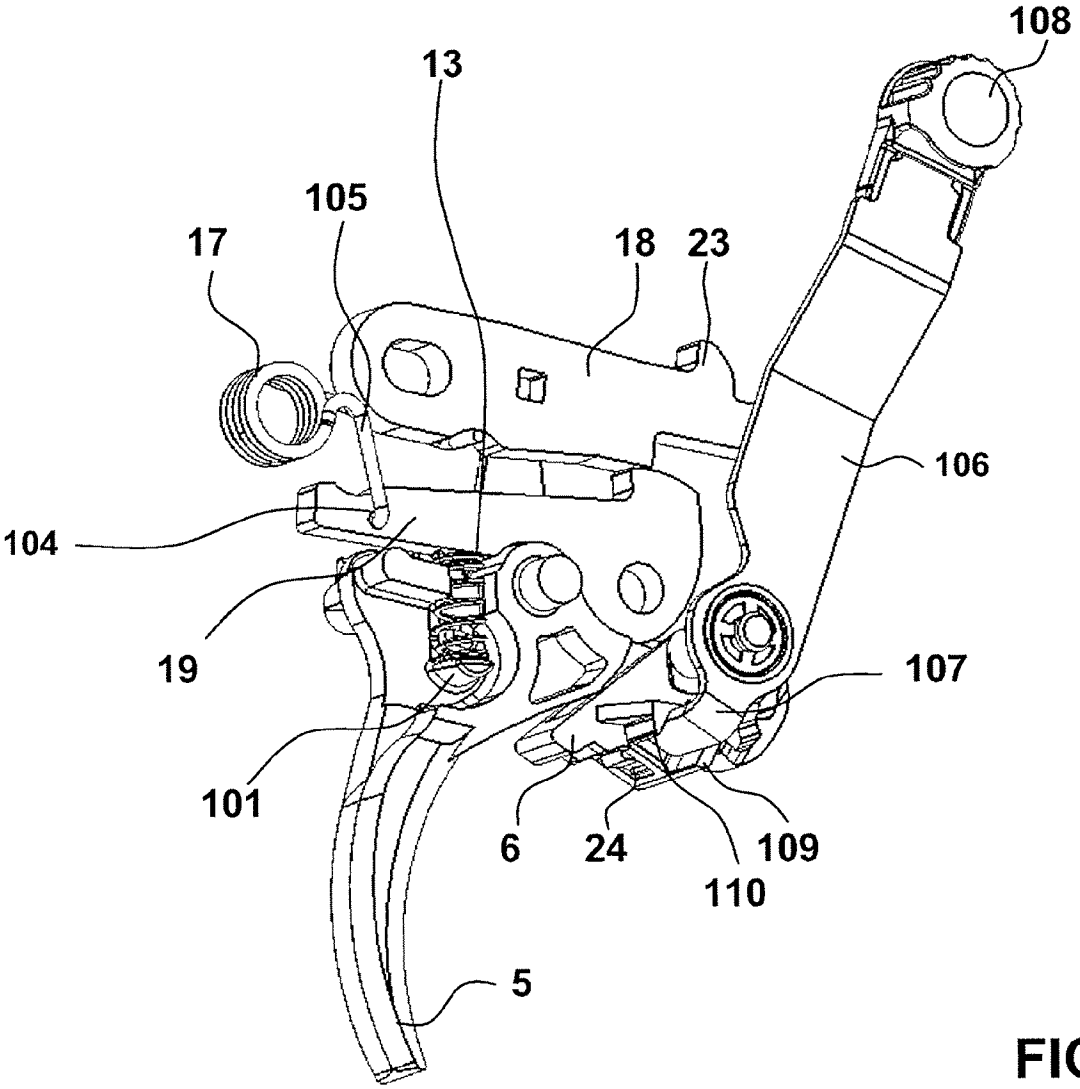
FIG. 7 is a view of the same firing mechanism as FIG. 5, but with another safety catch option
Figure 8:
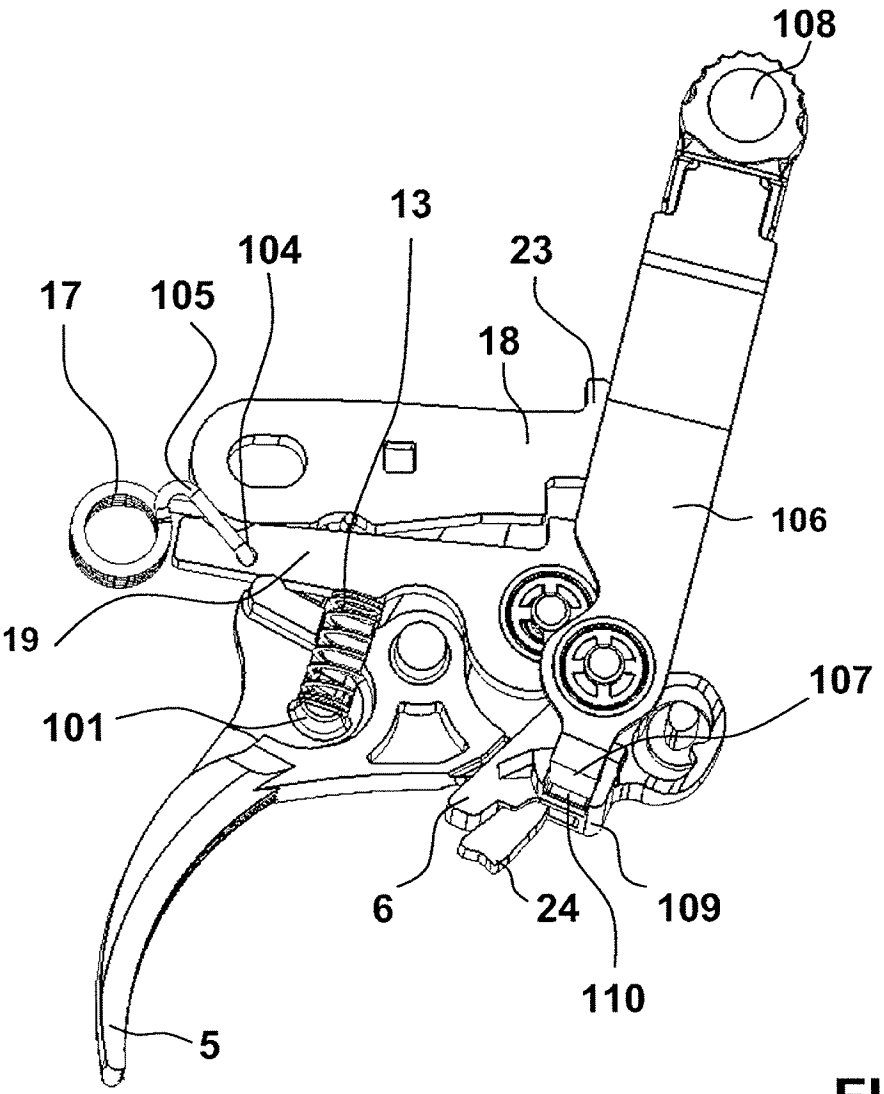
FIG. 8 is a lateral view from the right, without the rigid profile and with the firing mechanism already fired and the safety catch of FIG. 7.

Lastly, FIGS. 7 and 8 represent trigger 5, first spring 17 with arm 105, projection 101, second spring 17, safety catch 6 with lever 106 and its handle 108, its elbow 107, and projection 109, pawl 18 with tooth 23 and the counter-pawl 19 with its orifice 104.

Thus, in a specific embodiment, this invention could operate, for example, in the same way as patent WO2010061010, from the same applicant company.

It is emphasised that said patent is used as the basis, even though this improvement may be extended to other firing mechanism types.

FIGS. 1, 2, 3, 4, 5 and 7, show the firing mechanism in the rest position, FIGS. 6 and 8, show the firing mechanism after firing, with the trigger 5 pressed.

When the rifle is loaded, safety catch 6 has to be released in order to allow to the user operate the trigger 5.

Trigger 5 comprises projection 24 that is introduced in first groove 25 belonging to mentioned safety catch 6. In this way, if safety catch 6 is not released when trying to move trigger 5, projection 24 will be locked by the safety catch 6 and thus, trigger 5 is locked and the sporting rifle cannot be fired.

Safety catch 6 comprises kidney-shaped aperture 16, with constriction 28 that defines two halves, one upper and one lower. Said aperture is crossed by fixed stub 15, belonging to rigid profile 14. In the safe position of this embodiment, stub 15 is in the lower half of aperture 16, thus locking possible trigger 5 action and assisted by constriction 28 that stabilises the safety catch position.

When safety catch 6 is moved by the finger, it overcomes the resistance of constriction 28, safety catch 6 is moved, leaving stub 15 in the upper half of aperture 16, with trigger 5 being then in the unlocked position.

There is another model of safety catch 6, as shown in FIGS. 7 and 8, in which safety catch 6 comprises lever 106 with its handle 108. Said lever 106 inferiorly ends in elbow 107 that is introduced in orifice 110, belonging to protrusion 109 of safety catch 6. Thus, on turning lever 106, elbow 107 rotates and projection 24 of safety catch 6 is released. Said projection 24 is the equivalent of projection 24 as illustrated FIG. 4.

When trigger 5 is pressed and it rotates about its axis, because trigger 5 is connected to first spring 13, it pushes this against counter-pawl 19, so that, depending on the elastic constant of said first spring 13, the balance of forces can be adapted to user requirements (more or less force to drive the first and second firing times).

It would be possible to add a regulating screw (not illustrated) to trigger 5, which affects counter-pawl 19. Thus, said screw regulates the distance separating trigger 5 from the counter-pawl and adjusts first spring 13 compression, lengthening or shortening the first time depending on the degree of compression of said first spring 3.

Therefore, if the regulator screw moves counter-pawl 19 away from trigger 5, it means that first spring 13 is decompressed so that the first time is lengthened, in other words, trigger 5 will travel further until counter-pawl 19 moves. On the other hand, if the regulator screw shortens the distance between counter-pawl 19 and trigger 5, which means that the first time is also shortened and consequently, trigger 5 will move counter-pawl 19 much earlier.

At the same time, arm 105 of second spring 107 exercises resistance against the movement of counter-pawl 19, by first spring 13, which enables trigger 5 to have resistance against the movement produced by the finger of the user. This results in a clearer differentiation and separation between the first and second firing times.

After firing finger pressure is removed from trigger 5, first spring 13 and second spring 17 return the various elements to their initial positions, except safety catch 6, which is manually operated by the actual user.

In this embodiment, first spring 13 is inferiorly supported on projection 101, which acts as a base. Said projection 101 is firmly joined to trigger 5. In this way, when trigger 5 is pressed and rotated, projection 101 pushes first spring 13 against counter-pawl 19.

In this embodiment, counter-pawl 19 has an overhanging part where the referred first spring 13 is superiorly supported so that first spring 13 directly pushes counter-pawl 19.

Another option would be that the counter-pawl has a second projection facing the first projection 101 that superiorly limits first spring 13.

It would be useful for arm 105 of second spring 17 to be fixed to counter-pawl 19. One way to do this would be by inserting part of arm 105 inside counter-pawl 19 through orifice 104.

In order for the so-called "second firing time" to have the desired effect, in other words, the reduction of the action force as the counter-paw is displaced, referred arm 105 is fixed at the end opposite interference zone 51 of counter-pawl 19 and also must have a special design. Moreover, since spring 13 is compressed on the counter-pawl, it assists in providing the force necessary to move the counter-pawl (second time).

It should be stressed here that second spring 17 is locked by one of its arms by pawl 18, which only possesses longitudinal movement because of the travel limitation of elongated hole 53 and arm 105 is the only one that is moved and from here, with the appropriate inclination, can provide the desired resistance to counter-pawl 19 advance movement.

In other words, arm 105 of the spring is arranged or adopts a configuration so that, in the breakdown of forces, the necessary rotational torque of second spring 17 is decreasing with respect to counter-pawl 19 rotational angle. This involves a drop in the driving force as trigger 5 is rotated when pressed by the finger of the user.

This invention patent describes a new firing mechanism for a sporting rifle. The examples mentioned here do not limit this invention and thus, can have various applications and/or adaptations, all of which are within the scope of the following claims.

The invention claimed is:

1. Firing mechanism for a sporting rifle, of the type comprising a trigger (5) and trigger safety catch (6), pawl (18) with piston locking tooth (23), counter-pawl (19), in contact with pawl (18) and trigger (5) said counter-pawl (19) also being kinetically coupled to trigger (5), with referred first portion locking pawl (18) movement and that releases said locking when trigger (5) is moved, wherein the firing mechanism comprises:

a first spring (13), configured between the trigger and counter-pawl (19), which is compressed and moved upwards when acted on by the finger of the user on the trigger (5) and which, when decompressed returns trigger (5) to its initial position, and a second spring (17) between pawl (18) and counter-pawl (19), with a spring arm (105) arranged so that, in breakdown of forces, the necessary rotational torque of second spring (17) decreases with respect to the rotation angle of the counter-pawl (19), thus reducing the driving force as trigger (5) is rotated when pressed by the finger of the user; wherein the arm (105) of second spring (17) is inserted in an orifice (104) of the counter-pawl (19).

2. The Firing mechanism according to claim 1, comprising a first projection (101) on the mentioned trigger (5), where the first spring (13) is supported by its lower end.

3. The Firing mechanism according to claim 1, wherein the counter-pawl (19) has an overhanging part where said first spring (13) is supported by its upper end.

4. The Firing mechanism according to claim 1, comprising a second projection on said counter-pawl (19), which superiorly limits first spring (13).

5. The Firing mechanism according to claim 1, wherein said arm (105) is fixed at the end opposite to interference zone (51) of counter-pawl (19).

* * * * *